US007503115B2

(12) United States Patent
Daut et al.

(10) Patent No.: US 7,503,115 B2
(45) **Date of Patent: *Mar. 17, 2009**

(54) ELECTROMAGNETIC HYDRAULIC VALVE, IN PARTICULAR A PROPORTIONAL VALVE FOR CONTROLLING A DEVICE FOR ADJUSTING THE ROTATION ANGLE OF A CAMSHAFT RELATIVE TO THE CRANKSHAFT IN AN INTERNAL COMBUSTION ENGINE, AND A METHOD FOR THE PRODUCTION THEREOF

(75) Inventors: Klaus Daut, Herzogenaurach (DE); Eduard Golovatai-Schmidt, Röttenbach (DE)

(73) Assignee: Schaeffler KG, Herzogenaurach (DE)

( * ) Notice: Subject to any disclaimer, the term of this patent is extended or adjusted under 35 U.S.C. 154(b) by 730 days.

This patent is subject to a terminal disclaimer.

(21) Appl. No.: 11/132,884

(22) Filed: May 19, 2005

(65) Prior Publication Data

US 2005/0207900 A1 Sep. 22, 2005

Related U.S. Application Data

(63) Continuation of application No. 10/955,221, filed on Sep. 30, 2004, now Pat. No. 6,928,967, which is a continuation of application No. PCT/EP03/02119, filed on Mar. 1, 2003.

(51) Int. Cl.
*B21D 51/16* (2006.01)

(52) U.S. Cl. ..... 29/890.12; 29/888.03; 29/890.128; 29/890.124; 29/890.126; 29/890.127; 29/527.5; 29/527.6; 123/90.12; 123/90.17; 123/90.16; 123/188.1; 251/129.08; 137/625.69; 137/625.34

(58) Field of Classification Search ..... 29/890.128, 29/888.03, 890.12, 890.124, 890.126, 890.127, 29/527.5, 527.6, 527
See application file for complete search history.

(56) References Cited

U.S. PATENT DOCUMENTS 5,348,232 A * 9/1994 Babitzka et al. ..... 239/585.4

(Continued)

FOREIGN PATENT DOCUMENTS

DE 198 53 670 5/2000

(Continued)

*Primary Examiner*—Rick K Chang
(74) *Attorney, Agent, or Firm*—Volpe and Koenig, P.C.

(57) ABSTRACT

An electromagnetic hydraulic valve (1), which including an electromagnet (2) with an armature (3) and of a valve housing (4) with an axial bore (5) and a piston valve (6) located therein is provided. The valve housing (4) includes several annular grooves (8, 9, 10) in which several radial openings (11, 12, 13) are located, which open into the axial bore (5), through which the hydraulic valve (1) has a fluid connection with a pressure connection (P), a tank connection (T) and two consumer connections (A, B). The piston valve (6) is acted upon by the armature (3) of electromagnet (2) and includes two ring-shaped control sections (14, 15), which connect alternatively the pressure connection (P) and the tank connection (T) with one of the consumer connections (A, B) through axial movement of piston valve (6). According to the invention, the radial openings (11, 12, 13) in valve housing (4) are provided as windows having a rectangular cross section. The cross section surface, released from the control sections (14, 15) of piston valve (6) form circular segments and can be changed in such a way that that flow through radial openings (11, 12, 13) in all of the positions of piston valve (6) is linear to each position of the armature (3) of the electromagnet (2).

17 Claims, 2 Drawing Sheets

U.S. PATENT DOCUMENTS

| | | | | |
|---|---|---|---|---|
| 5,617,895 | A | 4/1997 | Pfuhl et al. | |
| 5,632,467 | A * | 5/1997 | Just et al. | 251/129.21 |
| 6,199,776 | B1 * | 3/2001 | Andorfer | 239/585.4 |
| 6,371,382 | B1 * | 4/2002 | Niethammer et al. | 239/1 |
| 6,687,997 | B2 * | 2/2004 | Dallmeyer et al. | 29/890.128 |
| 6,811,104 | B2 * | 11/2004 | Kobayashi et al. | 239/533.2 |
| 7,051,961 | B2 * | 5/2006 | Mills et al. | 239/585.4 |
| 7,093,362 | B2 * | 8/2006 | Dallmeyer et al. | 29/890.124 |
| 7,162,355 | B2 * | 1/2007 | Yoda et al. | 701/104 |
| 7,204,433 | B2 * | 4/2007 | Kobayashi et al. | 239/533.2 |
| 7,314,184 | B2 * | 1/2008 | Hornby | 239/88 |
| 7,347,383 | B2 * | 3/2008 | Dallmeyer et al. | 239/5 |
| 7,377,040 | B2 * | 5/2008 | Hornby | 29/890.1 |
| 2002/0134444 | A1 | 9/2002 | Isobe | |

FOREIGN PATENT DOCUMENTS

| | | |
|---|---|---|
| EP | 0 443 779 | 8/1991 |
| JP | 10220258 | 8/1998 |

* cited by examiner

ELECTROMAGNETIC HYDRAULIC VALVE, IN PARTICULAR A PROPORTIONAL VALVE FOR CONTROLLING A DEVICE FOR ADJUSTING THE ROTATION ANGLE OF A CAMSHAFT RELATIVE TO THE CRANKSHAFT IN AN INTERNAL COMBUSTION ENGINE, AND A METHOD FOR THE PRODUCTION THEREOF

CROSS-REFERENCE TO RELATED APPLICATIONS

This application is a continuation of U.S. patent application Ser. No. 10/955,221, filed Sep. 30, 2004, which is a continuation of PCT/EP03/02119, filed Mar. 1, 2003, which is incorporated by reference herein as if fully set forth.

BACKGROUND

The invention relates to an electromagnetic hydraulic valve as well as a method of its production. The electromagnetic hydraulic valve is especially beneficial for use with proportional valves for controlling of a device for adjusting the rotation angle of a camshaft relative to the crankshaft in an internal combustion engine.

From DE 198 53 670 A1 a category-defining proportional valve for the controlling of a device for adjusting the rotational angle of a camshaft relative to the crankshaft of an internal combustion engine is provided, which consists essentially of a cylindrical hollow electromagnet with an armature which moves in it axially, and of a cylindrical valve housing with an axial bore, and a piston valve set in it. The piston valve, which is designed as a hollow piston, is set with the armature of the electromagnet, in such an interaction by means of a valve push rod that the magnetic attraction axially moving the armature when the current feed is applied to the electromagnet, is transmitted to the piston valve and shifts it axially in the fixed axial bore of the valve housing against the force of a compression spring. Furthermore, the valve housing comprises in on a periphery thereof three annular grooves axially spaced from each other, in which several equally distributed radial openings are configured, which open into the axial bore of the valve housing. Above the radial bores as well as above the one-sided open bore in the valve housing there is a proportional valve with a pressure connection, tank connection and two consumer connections in the air connection, by means of which the in- and outflow of the hydraulic medium to and from the pressure chambers of the device used to adjust the rotation angle of a camshaft is controlled. The respective rate of flow is thereby adjusted by means of two annular control sections at the ends of the piston valve which in accordance to the current feed of the electromagnet and the axial position of the piston valve release a part of the opening cross section of the radial bores of the consumer connections and therefore alternatively connect the pressure connection and the tank connection to one of the consumer connections. At the same time, the control sections of the piston valve and the gutters of the valve housing, which originate between the individual radial bores of each consumer connection, create a guide for the piston valve within the axial bore of the valve housing, by means of which a seizure of the piston valve in its axial displacement is therefore avoided.

Proportional valves designed in such a way show this undoubtable advantage that the control sections of the piston valve are at the same time also its bearing surfaces in the axial bores of the valve housing and in this way both the piston valve and the valve housing have a relatively short face-to-face length. But this faces the disadvantage that at least the radial bores in the valve housing, which belong to the consumer connections, because of their overall relatively small opening cross section surface make possible only a low flow of hydraulic medium through the valve and moreover because of the semicircular forms of the opening cross section of these radial bores the flow of the hydraulic medium through the valve in the individual positions of the piston valve is not linear to the respective position of the armature of the electromagnet. When such a proportional valve is applied for the controlling of a device for adjusting the rotational angle of a camshaft, it implicates on the one hand that the valve has a large internal hydraulic resistance, which is expressed in a high pressure drop on the consumer connections and at least in case of devices with a relatively high intake capacity it implicates that their maximum rate of change remains under a permitted minimum face value. On the other hand the non-linear flow through the valve has the effect that the adjustment pressure, which is necessary for a fast adjustment process, takes place in each pressure chamber of the device relatively late because the linear control sections of the piston valve open the round radial bores of the consumer connections first only at the bore edge with a minimum opening cross section until the opening cross section is larger and larger by way of following the axial movements of the piston valve and then in the final position the necessary adjustment pressure is reached. Furthermore, the radial bores in the valve housing have also proved to be disadvantageous regarding the production process because the exact bore of the radial borings is very time consuming and cost-intensive and moreover requires laborious subsequent machining to remove the splinters and ridges.

There are already several solutions known to avoid these disadvantages in which the proportional valve, similar to the solution revealed in DE 100 51 614 A1 , has a piston valve in the valve housing, which is led on the radial surfaces of two additional guides in the axial bores set on the ends of the piston valve. Those additional guides on the piston valve make it possible that the control sections of the piston valve do not need to undertake any leading functions and therefore can be freely accommodated by rotating versus two annular grooves in the axial bore of the valve housing. Both of those annular grooves are laterally limited by two piston lands and each of them is connected through a large surfaced one-sided radial opening in the valve housing with the consumer connections. The piston lands of those annular grooves interact here with the control sections of the piston valve in such a way that in accordance with the current feed of the electromagnet and the axial position of the piston valve connected with that a complete circular opening cross section is released to the annular grooves and with that the pressure connection and the tank connection is connected alternatively with the consumer connections.

As a result the advantage of such a designed proportional valve is provided first of all in the relatively large, circular opening cross section surface in each position of the piston valve, which enables a high and moreover linear compared to the displacement of armature of the electromagnet flow of hydraulic medium through the valve, and consequently assures fast adjustment processes in a device for the adjustment of the rotational angle of the camshaft. But a disadvantage must be accepted that the piston valve has a relatively large face-to-face length, which is caused by the additional guides that therefore, correspondingly, a long valve housing also needs deep inserting bores. Furthermore, because of the one-sided design of the radial openings in the valve housing both to the consumer connections as well as to the pressure and tank connection such a proportional valve needs an exact emplacement position and is therefore applicable only in correspondingly designed connecting lines.

SUMMARY

Therefore, the object that underlies the invention is to design an electromagnetic hydraulic valve, in particular, a proportional valve for controlling a device for adjusting the rotation angle of a camshaft relative to a crankshaft in an internal combustion engine, which combines a simple and cost-efficient production with the advantages of the known proportional valves, and has both a short face-to-face length of the valve housing as well as piston valve and large opening cross section areas for the radial openings, and enables a high and linear flow, based on the alignment of the electromagnet armature, of hydraulic medium through the valve.

This object is solved in the case of the electromagnetic hydraulic valve according to the invention in that the radial openings which end into the axial bore of the valve housing are formed with a cross section shaped as quadrangular windows, whose cross section surface released by the control sections of the piston valve form radial segments and can be changed through axial displacement of the piston valve in such a way that the flow through the radial openings is in all of the positions of the piston valve linear to each position of the armature of the electromagnet.

In an appropriate further development of the electromagnetic hydraulic valve according to the invention, the radial openings have here preferentially a rectangular opening cross section, whose longer axial edges extend in a circumferential direction of the valve housing and are located parallel to the control sections of the piston valve. The distance between the axial edges of radial openings corresponds here to the width of the control sections so that the quadrangular radial openings of consumer connections can also be closed in a middle position of the piston valve.

With respect to the length of individual radial openings with a quadrangular opening cross section, it has proved to be advantageous in the further arrangement of the electromagnet hydraulic valve according to the invention to set them in such a way that in all annular grooves of the valve housing, only three such radial openings are placed evenly on a common perpendicular axis. In this way, with axial movement of the piston valve on the radial openings of consumer connections in a desirable way, relatively large opening cross section surfaces in form of circular segments are generated, which essentially reduce the internal hydraulic valve resistance and make possible large flows of hydraulic medium through the valve. At the same time it is ensured that in such a design the piston valve is guided without jams through its control sections on the three remaining quadrangular web portions between the radial openings of the consumer connections.

It is of course also possible in an alternative design of the hydraulic valve according to the invention to provide the radial openings, designed as quadrangular windows, as only rectangular and to set in each annular groove of valve housing more than three of the radial openings, if this were necessary or sufficient with respect to the required flow. Also, it is conceivable to provide a different amount of radial openings on the consumer connections compared to the radial openings to pressure and tank connections of valve and/or a different form of cross section between the radial openings of the consumer connections and the radial openings of pressure and tank connections of the valve. Also, the quadrangular design of all radial openings is possible, with less or more than three radial openings, or to change the amount and form of cross section between the consumer connections and the pressure and tank connections, whereas at least the consumer connections shall be provided equally overall with the opening cross sections, and sufficient guides must be provided for the piston valve.

Additionally, a procedure for the manufacturing of hydraulic valves according to the invention is provided which, in a case of preferential usage of a light alloy or nonferrous metal for the valve housing, that the radial openings in the valve housing be done when up to three windows per annular groove through the so-called multi-edge cutting on a turning machine. In this procedure, known among experts for the manufacture of even-numbered outer surfaces, such as surfaces of keys, squares and hexagonals, on the periphery of a rotating work piece, a rotating milling head set axially parallel to the valve housing is used with three cutters set side by side in equal distance to the annular grooves, which have a quadrangular cutting geometry, and with which all radial openings in all three annular grooves of valve housing are produced in one working cycle. The speed ratio between the milling head and the lathe spindle amounts here correspondingly to the amount of radial opening per annular groove between 3:1 and 1:1, which means that in the case of radial openings per annular groove 1:1, in case of two radial openings per annular groove 2:1, and three radial openings per annular groove 3:1. If permitted by the peripheral surface of the valve housing and/or the remaining web width between the radial openings, it is also possible to produce in this procedure using different speed ratios between the milling head and the lathe spindle and/or through a different cutter amount per annular groove more or less than three radial openings per annular groove. Alternatively, as a manufacturing procedure of the hydraulic valve for the valve housing according to the invention it is also possible to use milling of quadrangular radial openings with a side milling cutter or manufacturing of the valve housing with all inner and outer contours through aluminium die casting, whereas the newly used multi-cornered cutting of radial openings has been proved as the most cost-efficient.

According to the invention, the electromagnetic hydraulic valve, in particular the proportional valve for controlling a device for adjusting the rotational angle of a camshaft relative to the crankshaft in an internal combustion engine, compared with known state of the art hydraulic valves represents the advantage that its valve housing, because of its short piston valve designed without additional guides, has a short face-to-face length, although by means of the rectangular radial openings in the annular grooves of valve housing there is assured a safe guidance of the piston valve on the remaining webs between and relatively large opening cross sections to the consumer connections. By means of rectangular form of cross sections of radial openings according to the invention, a flow of hydraulic medium through the valve is possible, which approximately reaches the values of proportional valves with additional piston guides. At the same time the rectangular radial openings are the reason for the fact that the flow of hydraulic medium through the valve as output variable is now in each position of piston valve linear or proportional to each output variable, such as the current feed which determines the position of armature. When a proportional valve for controlling a device for adjusting the rotational angle of a camshaft relative to the crankshaft in an internal combustion engine manufactured according to the invention is used, it has the advantage that the valve only has a small amount of internal hydraulic resistance, and therefore the device allows pressure build-up faster in its pressure chambers, and therewith high adjustment speed. Through the manufacturing procedure of an electromagnetic hydraulic valve done according to the invention, it is also possible to arrange the production of valve housing with rectangular radial openings without costly subsequent machining, very cost-effective and productive, and therewith lower the overall manufacturing costs of hydraulic valves.

BRIEF DESCRIPTION OF DRAWINGS

The invention will be explained in detail below and is presented schematically in appended drawings. Shown are.

DETAILED DESCRIPTION OF THE PREFERRED EMBODIMENTS

Figure 1:
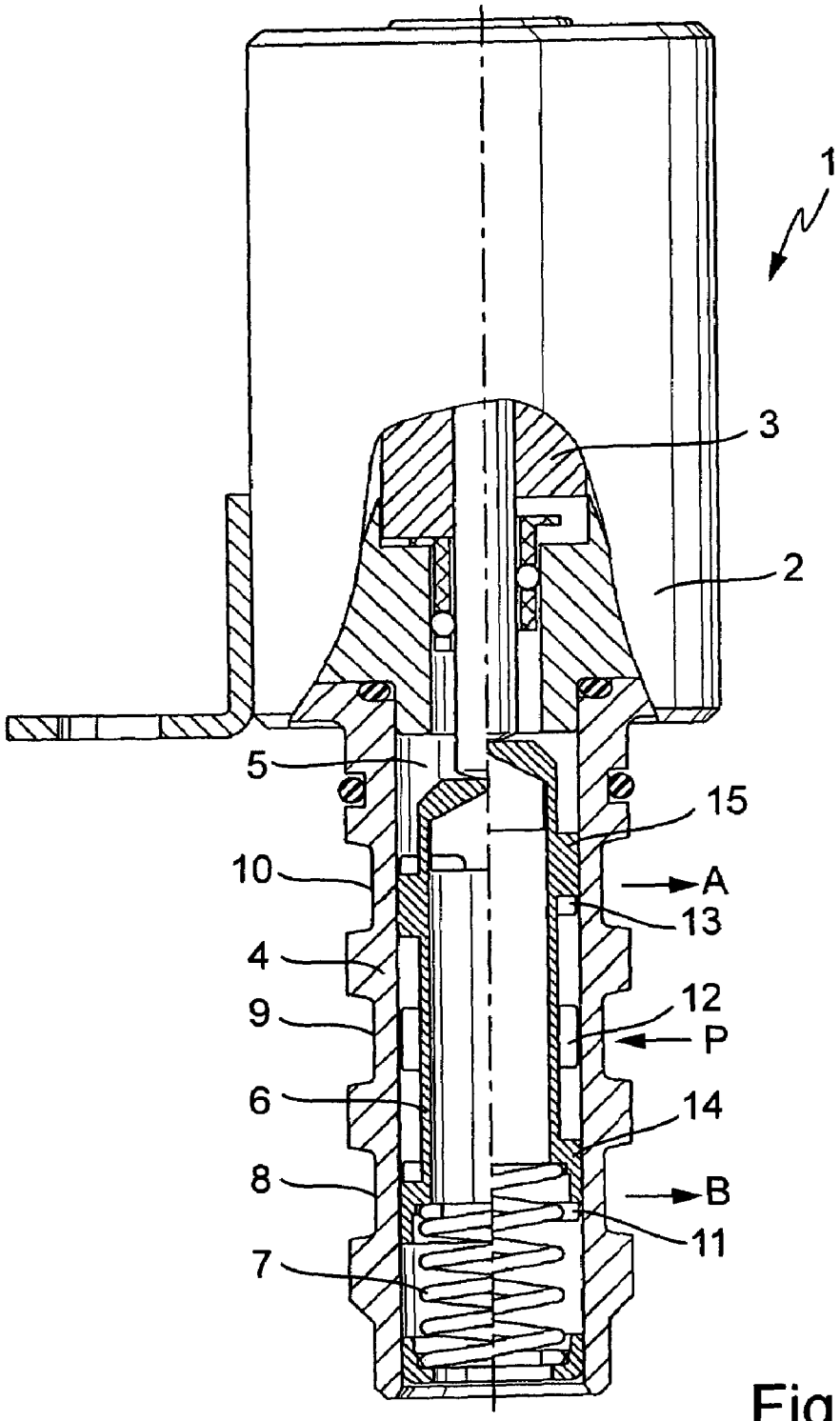
FIG. 1 is a partial longitudinal section view of a hydraulic valve according to the invention shown in a longitudinal split with and without current feed.

From FIG. 1 it is clear that an electromagnetic hydraulic valve 1 is provided which includes essentially a cylindrical hollow electromagnet 2 with an armature 3 which moves in it axially, and of a cylindrical valve housing 4 with an axial bore 5, and a piston valve 6 set in it. The piston valve 6, designed as a hollow piston, is positioned here with the armature 3 of the electromagnet 2 through a partially described valve push rod in such a power interaction and can be moved axially in the through extending axial bore 5 of the valve housing 4, as presented in FIG. 1, which is shown split along the longitudinal medium line, against the force of the compression spring 7.

Additionally, in FIG. 1 it can be seen that the valve housing 4 has three axially positioned annular grooves 8, 9, 10, in which evenly distributed radial openings 11, 12, 13 are provided which open into the axial bore 5 of the valve housing 4. Through the radial openings 11, 12, 13 as well as through the open one-side of the axial bore 5 in valve housing 4 a hydraulic valve 1 is connected with a pressure connection P, a tank connection T, and two consumer connections A, B, through which is regulated the in- and outflow of a hydraulic medium to and from the pressure chamber of a device for the adjustment of a rotational angle of a camshaft (not shown).

Figure 2:
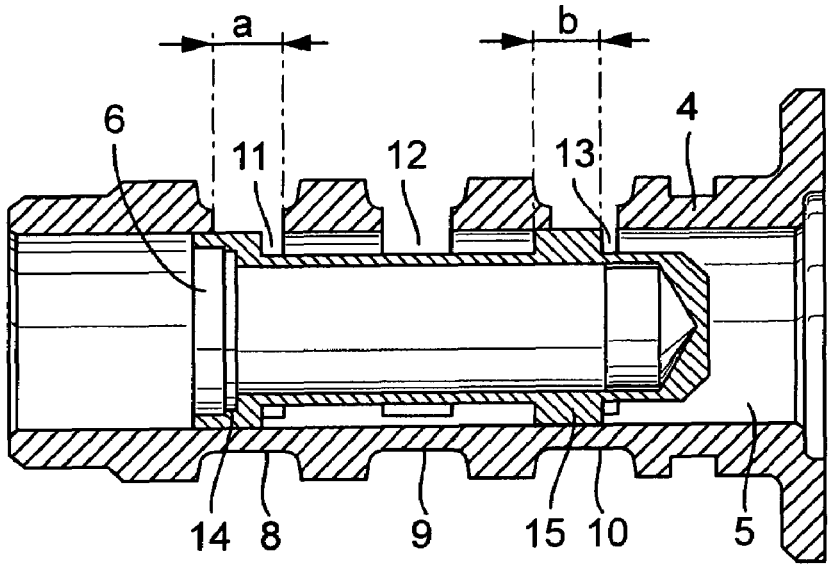
FIG. 2 is a longitudinal section view through the valve housing and the piston valve of the hydraulic valve according to the invention.
Figure 3:
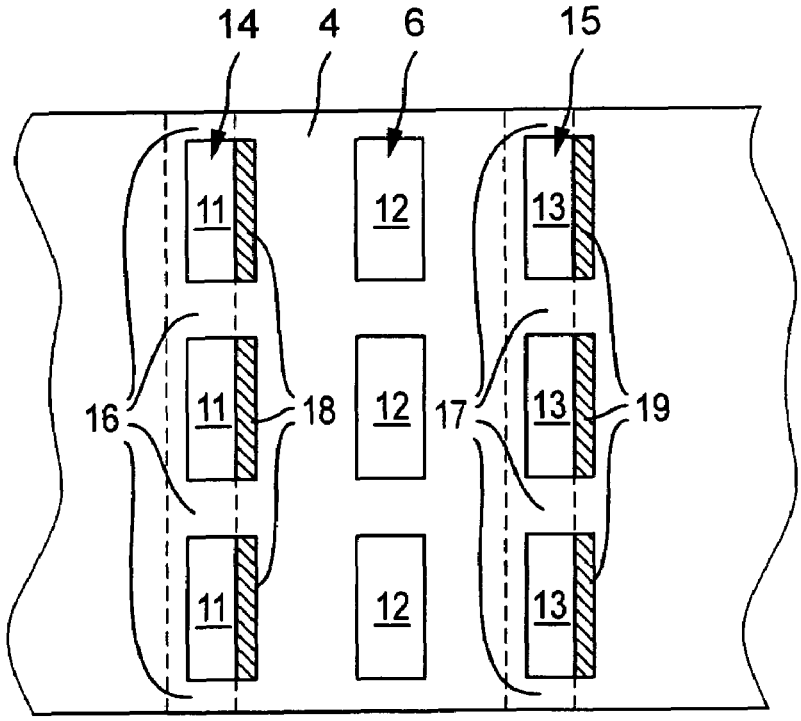
FIG. 3 is a partial view of the valve housing with the piston valve of the hydraulic valve according to the invention.

In FIGS. 2 and 3 it can be recognized that the piston valve 6 for controlling the flow of hydraulic medium through hydraulic valve 1 has on its ends two annular control sections 14, 15, which connect through axial movement of piston valve 6, the pressure connection P and the tank connection T alternatively with one of the consumer connections A, B, and at the same time together with the connecting webs 16, 17, which remain between individual radial openings 11, 13 of each consumer connection A, B, form the guide for the piston valve 6 within the axial bore 5 of valve housing 4.

It is also clear from the valve housing 4 and piston valve 6 according to the invention as shown in FIG. 3, that the radial openings 11, 12, 13, which open into the axial bore 5 of valve housing 4, are provided with a cross section in the form of rectangular-shaped windows to the furthest extent possible, through which it is possible, to achieve a higher flow of hydraulic medium through hydraulic valve 1 than with round radial openings. The cross section surface 18, 19 released through control sections 14, 15 of piston valve 6 in the radial openings 11, 13 of consumer connections A, B, shown in the drawing as shaded, are here designed in the form of circular segments, and can be changed through an axial movement of piston valve 6 in such a way, that the flow through radial openings 11, 12, 13 is linear in all of the positions of piston valve 6 to each position of armature 3 of electromagnet 2.

An especially advantageous form of the invention provides the valve housing 4, as shown in drawings, with each annular groove 8, 9, 10 on each common perpendicular axis, each having three radial openings 11, 12, 13 with a rectangular opening cross section, which extends in the direction of valve housing 4, whose axial edges that are designed parallel to the control sections 14, 15 of piston valve 6, as shown in FIG. 2, set some distance from each other, which corresponds to the breadth b of control sections 14, 15 of piston valve 6. The three rectangular connecting webs 16, 17, remaining between radial openings 11 and 13, according to FIG. 3 form the guides for the control sections 14, 15 of piston valve 6 in the axial bore 5 of valve housing 4, through which the piston valve 6 can be moved axially without jams in valve housing 4.

Manufacturing of the three radial openings 11, 12, 13 for each annular groove 8, 9, 10 in the valve housing 4, which is preferably formed of a light metal, takes place through multi-edge cutting on a turning machine, in which a rotating milling head set axially parallel to valve housing 4 is used with three cutters, set side by side in equal distance of annular grooves 8, 9, 10 using rectangular cutting geometry, whereas the speed ratio between the milling head and the lathe spindle is 3:1.

LIST OF REFERENCE NUMBERS

1 Hydraulic valve
2 Electromagnet
3 Armature
4 Valve housing
5 Axial bore
6 Piston valve
7 Compression spring
8 Annular groove
9 Annular groove
10 Annular groove
11 Radial opening
12 Radial opening
13 Radial opening
14 Control section
15 Control section
16 Connecting web
17 Connecting web
18 Released cross section surface
19 Released cross section surface
A Consumer connection
B Consumer connection
P Pressure connection
T Tank connection
a Axial edges
b Broad control sections

The invention claimed is:

1. A method for producing an electromagnetic hydraulic valve, the method comprising:

forming a cylindrical valve housing (4) having an axial bore (5) with a piston valve (6) and a compression spring (7) located therein, the piston valve (6) being axially movable in the axial bore (5) of the valve housing (4) against a restoring force of the compression spring (7);

forming a plurality of annular grooves (8, 9, 10) on a periphery of the valve housing (4) spaced apart axially from each other; and forming at least one radial opening (11, 12, 13) in each of the plurality of annular grooves which opens into the axial bore (5) of the valve housing (4), the radial openings each having a generally quadrangular cross section window;

wherein forming the radial openings (11, 12, 13) includes turning the valve housing on a lathe spindle of a turning machine on an axis generally parallel to the axial bore (5) and engaging a rotating milling head with the valve housing (4), the milling head including axially spaced cutters having quadrangular cutting geometries for forming the radial openings (11, 12, 13).

2. The method according to claim 1, wherein the forming of the at least one radial opening in each of the plurality of annular grooves comprises forming a single radial opening in at least one of the plurality of annular grooves, and further comprising controlling a speed ratio between the milling head and the lathe spindle equal to approximately 1:1.

3. The method according to claim 1, wherein the forming of the at least one radial opening in each of the plurality of annular grooves comprises forming two of the radial openings in at least one of the plurality of annular grooves, and further comprising controlling a speed ratio between the milling head and the lathe spindle equal to approximately 2:1.

4. The method according to claim 1, wherein the forming of the at least one radial opening in each of the plurality of annular grooves comprises forming three of the radial openings in at least one of the plurality of annular grooves, and further comprising controlling a speed ratio between the milling head and the lathe spindle equal to approximately 3:1.

5. The method according to claim 1, further comprising connecting an electromagnet (2) with an axially movable armature (3) to the piston valve for actuating the piston valve.

6. The method according to claim 1, further comprising forming the cylindrical valve housing from a nonferrous material.

7. The method according to claim 1, further comprising forming the cylindrical valve housing from a nonferrous alloy material.

8. A method for producing an electromagnetic hydraulic valve, the method comprising:

forming a cylindrical valve housing (4) having an axial bore (5) with a piston valve (6) and a compression spring (7) located therein, the piston valve (6) being axially movable in the axial bore (5) of the valve housing (4) against a restoring force of the compression spring (7);

forming a plurality of annular grooves (8, 9, 10) on a periphery of the valve housing (4) spaced apart axially from each other; and forming at least one radial opening (11, 12, 13) in each of the plurality of annular grooves which opens into the axial bore (5) of the valve housing (4), the radial openings each having a generally quadrangular cross section window;

wherein forming the radial openings (11, 12, 13) includes milling the quadrangular radial openings with a side milling cutter.

9. The method according to claim 8, further comprising connecting an electromagnet (2) with an axially movable armature (3) to the piston valve for actuating the piston valve.

10. The method according to claim 8, further comprising forming the cylindrical valve housing from a nonferrous material.

11. The method according to claim 8, further comprising forming the cylindrical valve housing from a nonferrous alloy material.

12. A method for producing an electromagnetic hydraulic valve, the method comprising:

forming a cylindrical valve housing (4) having an axial bore (5) with a piston valve (6) and a compression spring (7) located therein, the piston valve (6) being axially movable in the axial bore (5) of the valve housing (4) against a restoring force of the compression spring (7);

forming a plurality of annular grooves (8, 9, 10) on a periphery of the valve housing (4) spaced apart axially from each other;

forming at least one radial opening (11, 12, 13) in each of the plurality of annular grooves which opens into the axial bore (5) of the valve housing (4), the radial openings each having a generally quadrangular cross section window; and wherein at least one of the forming steps includes die casting.

13. The method according to claim 12, further comprising performing the die casting with aluminum.

14. The method according to claim 12, wherein all of the forming steps include die casting.

15. The method according to claim 12, further comprising connecting an electromagnet (2) with an axially movable armature (3) to the piston valve for actuating the piston valve.

16. The method according to claim 12, further comprising forming the cylindrical valve housing from a nonferrous material.

17. The method according to claim 12, further comprising forming the cylindrical valve housing from a nonferrous alloy material.

* * * * *